US010801295B2

(12) United States Patent
Johnsen

(10) Patent No.: US 10,801,295 B2
(45) Date of Patent: Oct. 13, 2020

(54) RISERLESS INTERVENTION SYSTEM AND METHOD

(71) Applicant: Welltec A/S, Allerød (DK)

(72) Inventor: Kim Johnsen, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 16/082,390

(22) PCT Filed: Mar. 13, 2017

(86) PCT No.: PCT/EP2017/055845
§ 371 (c)(1),
(2) Date: Sep. 5, 2018

(87) PCT Pub. No.: WO2017/157854
PCT Pub. Date: Sep. 21, 2017

(65) Prior Publication Data

US 2019/0071947 A1 Mar. 7, 2019

(30) Foreign Application Priority Data

Mar. 14, 2016 (EP) ..... 16160230
Mar. 14, 2016 (EP) ..... 16160232

(51) Int. Cl.
*E21B 33/076* (2006.01)

(52) U.S. Cl.
CPC ..... *E21B 33/076* (2013.01)

(58) Field of Classification Search
CPC ..... E21B 33/076; E21B 33/068; E21B 33/072
See application file for complete search history.

(56) References Cited

U.S. PATENT DOCUMENTS 3,987,910 A 10/1976 Brunato
4,127,167 A * 11/1978 Arendt ..... E21B 33/037 166/381
6,250,395 B1 * 6/2001 Torres ..... E21B 17/20 166/382
6,321,846 B1 * 11/2001 Rytlewski ..... E21B 33/064 166/363
2005/0178540 A1 * 8/2005 Siewert ..... E21B 33/072 166/88.1
2007/0175639 A1 8/2007 Hoen
2008/0264643 A1 * 10/2008 Skeels ..... E21B 33/076 166/348

(Continued)

FOREIGN PATENT DOCUMENTS

WO 2016/028412 2/2016

OTHER PUBLICATIONS

International Search Report and Written Opinion of the ISA for PCT/EP2017/055845, dated May 15, 2017, 13 pages.

(Continued)

*Primary Examiner* — James G Sayre
(74) *Attorney, Agent, or Firm* — Nixon & Vanderhye P.C.

(57) ABSTRACT

A riserless intervention system for offshore intervention of a well from a vessel includes a lubricator pipe configured to connect with the top of the well and a tool string is configured to be arranged in the lubricator pipe. A closing part is arranged at a pipe end and configured to close fluid communication through an opening of the end of the lubricator pipe to allow the lubricator pipe to be filled with fluid before being connected to the top of the well.

22 Claims, 17 Drawing Sheets

(56) References Cited

U.S. PATENT DOCUMENTS

| | | | | |
|---|---|---|---|---|
| 2011/0203803 | A1 | 8/2011 | Zemlak et al. | |
| 2013/0206419 | A1* | 8/2013 | Hallundbaek | E21B 33/06 166/341 |

OTHER PUBLICATIONS

Extended Search Report for EP16160232.1, dated Aug. 30, 2016, 6 pages.
Extended Search Report for EP16160230.5, dated Aug. 26, 2016, 6 pages.

* cited by examiner

RISERLESS INTERVENTION SYSTEM AND METHOD

This application is the U.S. national phase of International Application No. PCT/EP2017/055845 filed 13 Mar. 2017 which designated the U.S. and claims priority to EP Patent Application No. 16160232.1 filed 14 Mar. 2016, and EP Patent Application No. 16160230.5 filed 14 Mar. 2016, the entire contents of each of which are hereby incorporated by reference.

FIELD OF THE INVENTION

The present invention relates to a riserless intervention system for offshore intervention of a well from a vessel by means of a tool string, the vessel having a waterline and the well having a top. Furthermore, the present invention relates to a riserless intervention method for offshore intervention of a well from a vessel by means of a riserless intervention system according to the present invention.

In addition, the present invention also relates to a riserless intervention method for offshore intervention of a well from a vessel by means of a tool string, the vessel having a waterline.

BACKGROUND ART

When performing a subsea intervention of a well where a tool string is submerged into the well to perform an operation, a riser is often installed at the top of the well from a vessel, and the tool string is subsequently assembled and submerged into the riser. However, setting up a riser takes approximately 90 days, and a vessel with sufficient capacity is rarely available with a few days' notice, and the operation thus requires more time for planning. Therefore, a riserless solution has been developed where a lubricator pipe is installed above a blowout preventer on the well head or Christmas tree. The tool string is then mounted on the vessel using a grease head and submerged into the water where it enters the lubricator pipe. The grease head is mounted on top of the lubricator pipe and encloses the tool in the lubricator pipe. Then, a flushing system surrounding the lubricator pipe exchanges the seawater in the lubricator pipe with glycol or ethylene glycol, and the lubricator pipe is subsequently pressurised and valves in the top of the well are opened and the intervention operation can occur.

However, due to environmental concerns, it has been a priority to focus on decreasing the amount of ethylene glycol which is let into the sea during such interventions. Furthermore, with the increased focus on reducing the costs of such interventions, the equipment used to perform the exchange of seawater with glycol to ensure that no glycol is let into the sea during this exchange also needs to be reduced to make the entire operation more affordable compared to the increase in oil production.

In addition, to enable mounting of a tool string on a vessel, the vessel has a derrick or a large crane for handling the tool string of 60 feet or more. A vessel capable of handling such long tool strings and lubricator pipes is one of the larger vessels, meaning that more planning is required and higher rental costs are involved.

However, with the increased focus on the costs related to performing such interventions, the time saved using a large vessel is money saved. There is therefore also a need for a method of performing riserless interventions in shorter time to minimise or possibly eliminate the need for these large vessels with a high mounting height.

SUMMARY OF THE INVENTION

It is an object of the present invention to wholly or partly overcome the above disadvantages and drawbacks of the prior art. More specifically, it is an object to provide an improved riserless intervention system with a reduced amount of equipment downhole so it is affordable to use compared to the output gained by the intervention operation.

It is also an object to provide an improved method of performing riserless interventions in shorter time to minimise or possibly eliminate the need for large vessels.

The above objects, together with numerous other objects, advantages and features, which will become evident from the below description, are accomplished by a solution in accordance with the present invention by a riserless intervention system for offshore intervention of a well from a vessel by means of a tool string, the vessel having a waterline and the well having a top, the riserless intervention system comprising:

a lubricator pipe comprising a first end and a second end, the second end being configured to connect with the top of the well, the first end having a first opening and the second end having a second opening, and the tool string configured to be arranged in the lubricator pipe, wherein a closing part is arranged at the second end and configured to close a fluid communication through the second opening of the second end of the lubricator pipe in order to allow the lubricator pipe to be filled with fluid before being connected to the top of the well.

Furthermore, the fluid may be supplied with an anti-freeze liquid.

The closing part may be a burst or rupture disc-shaped part.

Also, the closing part may be comprised in a closing unit having an actuator configured to bring the closing part from at least a closed position to an open position.

Moreover, the closing part may have at least two sections.

The riserless intervention system as described above may further comprise a grease head configured to be connected with the first end of the lubricator pipe, the grease head being arranged for closing fluid communication through the first opening of the first end of the lubricator pipe.

Further, the lubricator pipe may comprise at least a first lubricator part and a second lubricator part.

In addition, the pipe sections may be connected by means of unions or flanges bolted together by bolts or similar fastening means.

Furthermore, the second lubricator part may be arranged closest to the grease head, the first lubricator part having an inner diameter which is larger than an inner diameter of the second lubricator part.

Moreover, the inner diameter of the first lubricator part may be larger than an outer diameter of a crown plug.

Also, the lubricator pipe may have an inlet.

The riserless intervention system as described above may further comprise a remotely operated vehicle (ROV).

The ROV may comprise a pump.

Furthermore, the ROV may comprise a motor drive pump.

Additionally, the ROV may comprise a pressure intensifier.

Moreover, the ROV may comprise a coupling configured to fluidly connect the pump to an inlet of the lubricator pipe to pressurise the lubricator pipe.

Further, the ROV may comprise a glycol reservoir (not shown).

A manual pump may be fluidly connected to the lubrication pipe.

Said manual pump may be configured to be operated by the ROV.

Also, pressure means may be arranged to pressurise a pressure inside the lubricator pipe.

In addition, the tool string may comprise first and second parts.

Moreover, the lubricator pipe may comprise a pressure equalising valve device for equalising the pressure inside the lubricator pipe with a liquid surrounding the lubricator pipe during descent of the lubricator pipe below the waterline.

Furthermore, the lubricator pipe may have a hydraulic accumulator.

The pressure equalising valve device may be configured to allow liquid to enter the lubricator pipe during descent and to allow liquid inside the lubricator pipe to leave the lubricator pipe during ascent.

The riserless intervention system as described above may further comprise a de-icing system.

Also, the riserless intervention system as described above may further comprise a vessel, the vessel having a vessel height above the waterline which is smaller than a length of the tool string.

Moreover, the riserless intervention system as described above may further comprise a blow-out preventer, a Christmas tree and/or a well head.

The lubricator pipe may further comprise a tool catcher configured to maintain the tool string at a predetermined position in the lubricator pipe.

Furthermore, a manual pump may be fluidly connected to the lubricator pipe.

Additionally, the system may comprise a plurality of lubricator pipes.

Further, the system may comprise a plurality of tool strings.

In addition, the vessel may comprise a suspension unit.

Also, the vessel may comprise a dynamic positioning system.

Moreover, the vessel may comprise a supply of anti-freeze liquid such as glycol.

The present invention also relates to a riserless intervention method for offshore intervention of a well from a vessel by means of a riserless intervention system as described above, the vessel having a waterline and the well having a top, the method comprising:

providing a lubricator pipe having a first end and a second end, the second end being configured to connect with the top of the well, the first end having a first opening and the second end having a second opening, closing the second opening of the second end of the lubricator pipe by means of a closing part, submerging the second end of the lubricator pipe in the closed position of the second end below the waterline so that the first end of the lubricator pipe extends above the waterline, arranging the tool string in the lubricator pipe, and supplying the lubricator pipe with an anti-freeze liquid before the lubricator pipe is submerged below the waterline.

In addition, the present invention relates to a riserless intervention method for offshore intervention of a well from a vessel by means of a tool string, the vessel having a waterline, the method comprising:

submerging a first end of a first part of the tool string below the waterline so that a second end of the first part extends above the waterline, arranging a second part of the tool string on top of the first part of the tool string, connecting a first end of the second part of the tool string with the second end of the first part of the tool string above the waterline, and submerging the second part of the tool string below the waterline.

In an embodiment, the riserless intervention method described above may further comprise introducing the tool string in a lubricator pipe.

Furthermore, before submerging the first end of the first part of the tool string below the waterline, the riserless intervention method may comprise submerging a first end of a first lubricator part of a lubricator pipe below the waterline so that a second end of the first lubricator part extends above the waterline; arranging a second lubricator part on top of the first lubricator part; and connecting a first end of the second lubricator part to the second end of the first lubricator part.

In an embodiment, the tool string may be submerged into the lubricator pipe.

Also, the riserless intervention method described above may further comprise connecting a grease head to the lubricator pipe above the waterline.

In addition, the lubricator pipe may be connected with a top of the well.

Moreover, the lubricator pipe may be connected with the top of the well while the tool string is arranged within the lubricator pipe.

In an embodiment, the riserless intervention method described above may further comprise arranging the tool string or the lubricator pipe in a suspension unit so that movements of the vessel are absorbed by the suspension unit.

Furthermore, the riserless intervention method described above may further comprise disconnecting the lubricator pipe from the top of the well.

In addition, the riserless intervention method may further comprise pulling the lubricator pipe at least partly above the waterline.

Moreover, the riserless intervention method may further comprise disconnecting the parts of the tool string.

Additionally, the riserless intervention method may further comprise disconnecting the parts of the lubricator pipe.

In an embodiment, before disconnecting the lubricator pipe from the top of the well, the riserless intervention method may further comprise closing the end of the lubricator pipe closest to the top of the well.

By closing the end of the lubricator pipe closest to the top of the well, the lubricator pipe is sealed from below, and its content is thereby brought to surface.

The vessel has a mounting height above the waterline which is smaller than a length of the tool string or a length of the lubricator pipe.

The riserless intervention method described above may further comprise the connecting a first end of a third part of the tool string to a second end of the second part of the tool string above the waterline.

In addition, the riserless intervention method may further comprise connecting a first end of a third lubricator part of the lubricator pipe to a second end of the second lubricator part of the lubricator pipe above the waterline.

Also, the riserless intervention method may further comprise introducing the tool string into the well to perform the intervention.

Moreover, the riserless intervention method may further comprise moving the tool string back into the lubricator pipe.

Furthermore, the riserless intervention method may further comprise opening a valve in a blowout preventer, a Christmas tree or a well head.

Finally, the riserless intervention method may further comprise opening a tool catcher.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
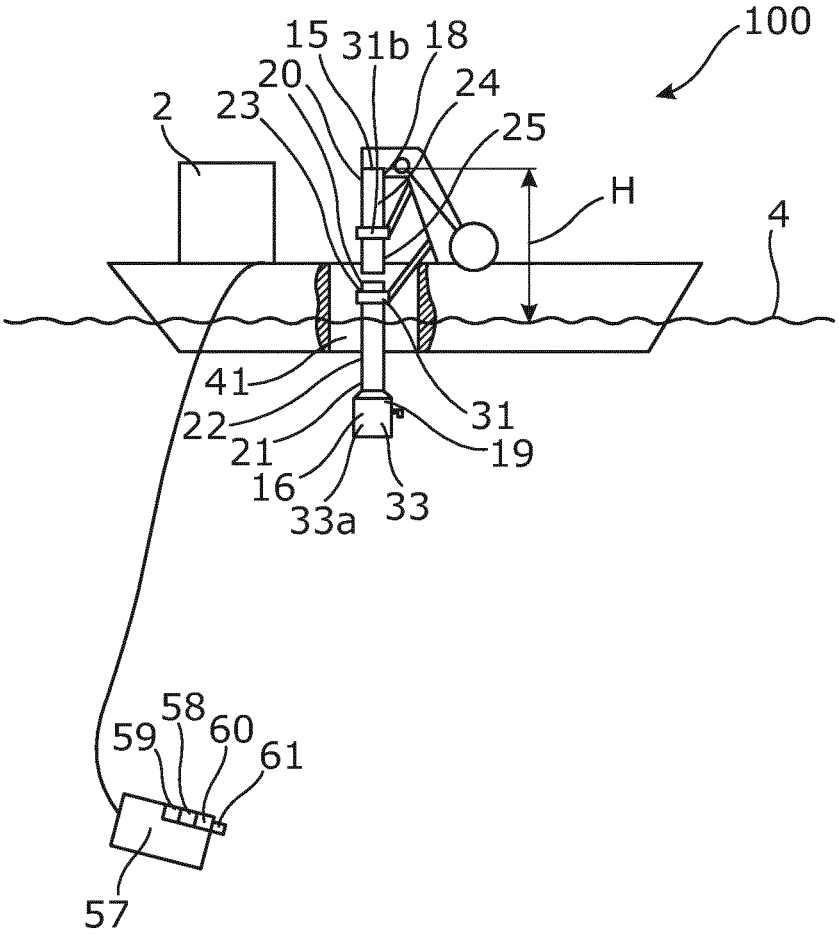
FIG. 1 shows a partially cross-sectional view of a small vessel in the process of mounting a riserless intervention system having a first lubricator part and a second lubricator part of a lubricator pipe.
Figure 1:
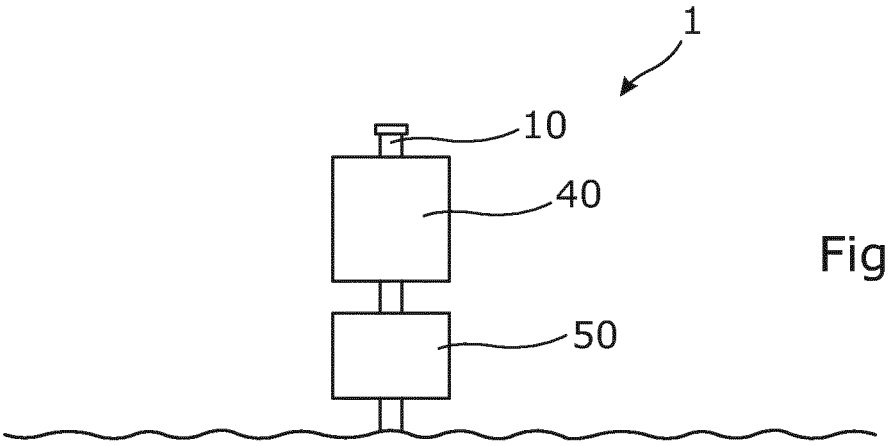
Figure 2:
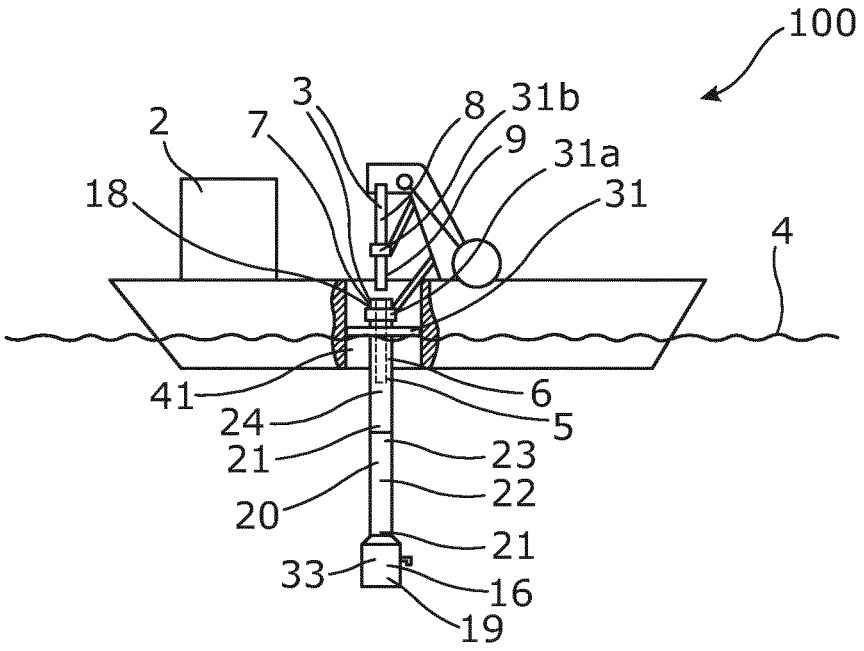
FIG. 2 shows a partially cross-sectional view of a small vessel in the process of mounting a first part and a second part of a tool string where the first part is partly within the lubricator pipe.
Figure 2:
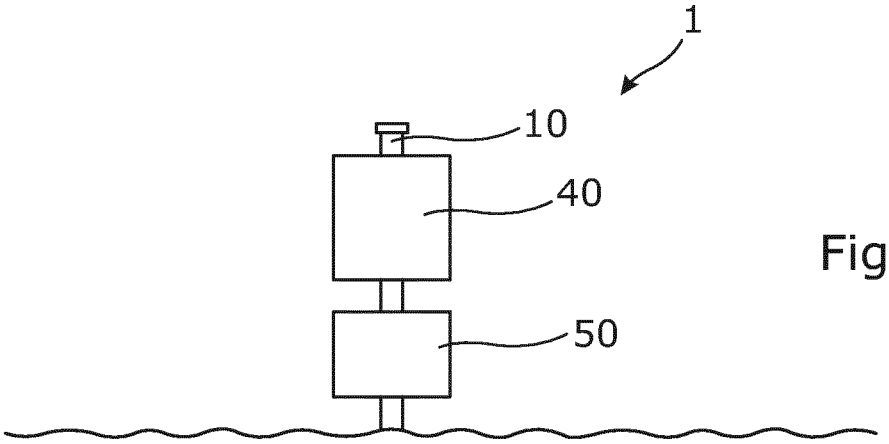

FIG. 1 shows a riserless intervention system 100 for offshore intervention of a well 1 from a vessel 2 by means of a tool string 3 (shown in FIG. 2). The riserless intervention system 100 comprises a lubricator pipe 20 comprising a first end 18 and a second end 19. The second end is configured to connect with a top 10 of the well. The first end has a first opening 15 for letting the tool string 3 into the lubricator pipe and the second end has a second opening 16 for letting the tool string in and out of the well. The riserless intervention system 100 further comprises a closing part 33 arranged at the second end for closing fluid communication through the second opening of the second end of the lubricator pipe. FIG. 2 thus shows a well 1 which is about to be intervened from a vessel 2 by an intervention tool in the form of a tool string 3 comprising at least a first part 6 and a second part 8. While assembling, the tool string 3 is part by part lowered down into a lubricator pipe 20 which is then mounted on e.g. a blowout preventer 40 or directly on a Christmas tree 50 forming the top 10 of the well 1.

By having a closing part 33 arranged at the second end, the second opening 16 can be closed when submerging the lubricator pipe 20 to connect with the top of the well, and thus the lubricator pipe 20 can be filled with glycol by means of equipment on board the vessel 2, which eliminates the need to have expensive subsea flushing equipment. Subsea flushing equipment is more expensive than conventional pumps at the deck, since the subsea flushing equipment must be able to withstand both a pressure which is a hundred times higher than the pressure at surface, and also very low temperatures. At the deck such equipment can easily be heated if necessary. Furthermore, having the equipment on board the vessel makes it is much easier to detect when the lubricator is filled with a sufficient amount of ethylene glycol as the glycol is merely poured into the lubricator pipe, and thus the equipment does not need to have detection means for detecting when the sea water in the lubricator is fully exchanged with glycol.

As shown in FIG. 1, the lubricator pipe 20 is mounted from the vessel 2 having a mounting height H smaller than a length L (shown in FIG. 3) of the lubricator pipe 20. The mounting height extends from the deck of a waterline 4 of the vessel 2 to the summit of the highest possible reach of the lubricator pipe in the upward direction. The lubricator pipe 20 is mounted by submerging the closing unit 33*a* partly below the waterline 4, and a first end 21 of a first lubricator part 22 of the lubricator pipe 20 is then connected to the closing unit 33*a* above the waterline. The vessel 2 may have a moon pool 41 into which the lubricator parts are lowered, or the lubricator pipe may be lowered over the side of the vessel (not shown). Then the first end 21 of a first lubricator part 22 of the lubricator pipe 20 is submerged below the waterline 4 so that a second end 23 of the first lubricator part is above the waterline. Subsequently, a second lubricator part 24 is arranged on top of the first lubricator part 22 and a first end 25 of the second lubricator part is connected to the second end 23 of the first lubricator part.

When the lubricator pipe 20 is assembled as shown in FIG. 2, the tool string 3 is mounted from the vessel 2 by submerging a first end 5 of a first part 6 of the tool string 3 below the waterline 4 so that a second end 7 of the first part extends above the waterline and is suspended in a suspension unit 31. Then, the second part 8 of the tool string 3 is arranged on top of the first part 6 of the tool string by a second suspension unit 31*b*, and a first end 9 of the second part 8 of the tool string is connected with the second end 7 of the first part of the tool string above the waterline 4 while the remaining part of the first part is below the waterline. In this way, the mounting height of the vessel 2 can be substantially reduced, which eliminates the a need for a large vessel, which in turn substantially reduces costs related to renting a vessel and further reduces the time needed for planning and performing the operation. Furthermore, the length of the tool string 3 is no longer restricted by the mounting height available on the vessel 2, and the tool string can now in theory be mounted with an endless length.

Figure 3:
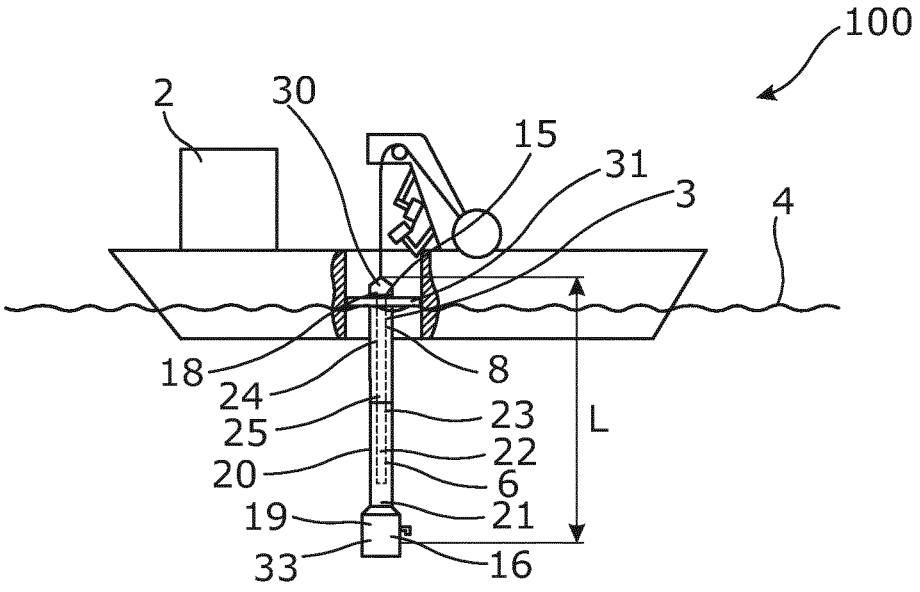
FIG. 3 shows a partially cross-sectional view of a small vessel in the process of lowering a lubricator pipe having a tool string therein into the sea.
Figure 3:
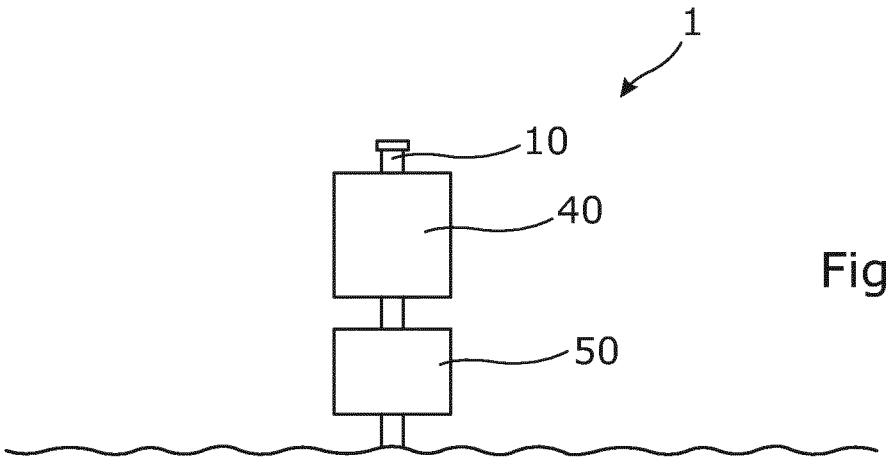

When also the tool string is assembled and arranged in the lubricator pipe 20, the lubricator is filled with glycol, and a grease head 30, as shown in FIG. 3, is connected to the first end 18 of the lubricator pipe 20 for closing a first opening 15 of the first end 18. Finally, the lubricator pipe 20 comprising the tool string 3 is submerged into the sea and is connected to the top 10 of the well 1 as shown in FIG. 4.

Figure 4:
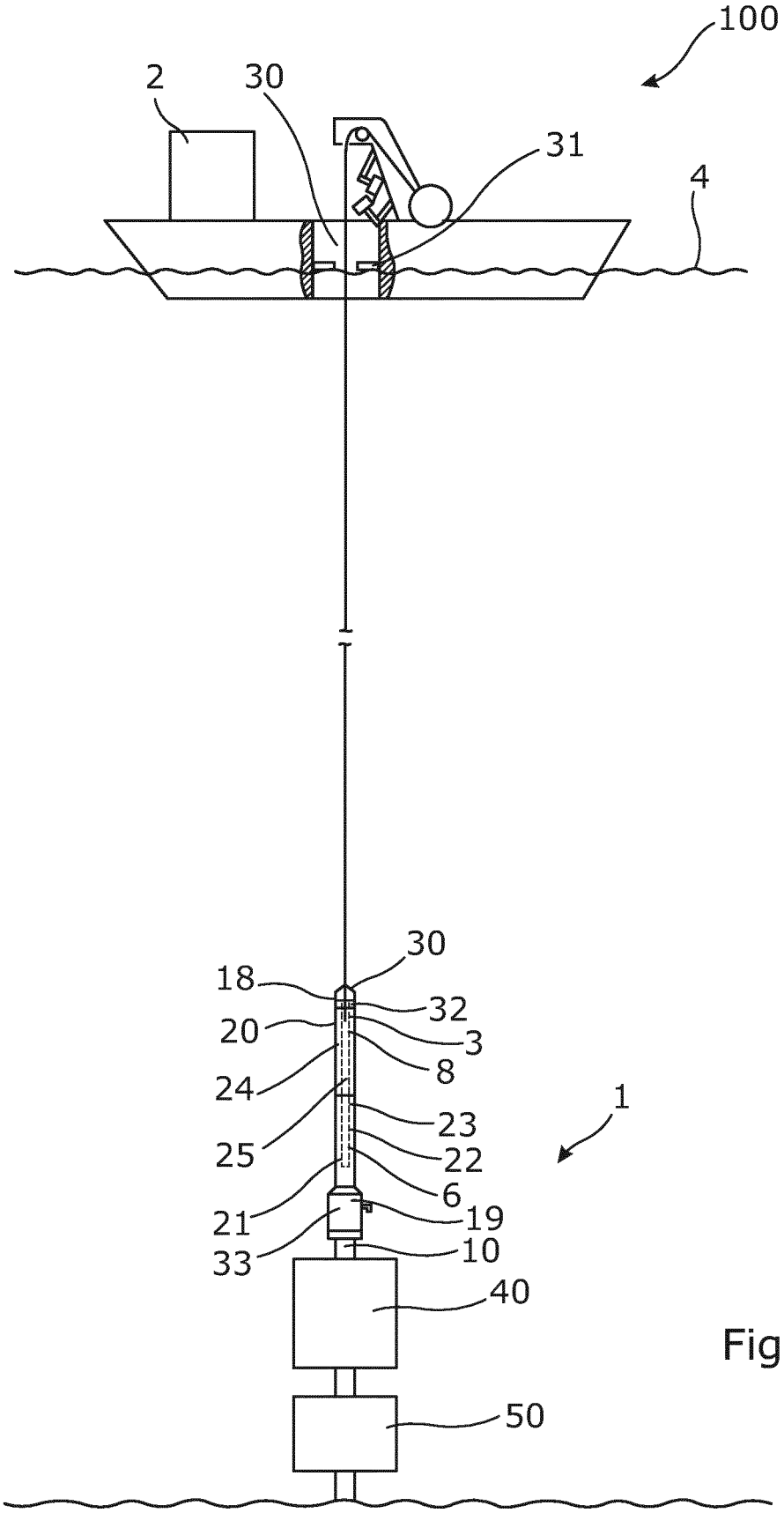
FIG. 4 shows the lubricator pipe of FIG. 3 being mounted on a top of a well.
Figure 5:
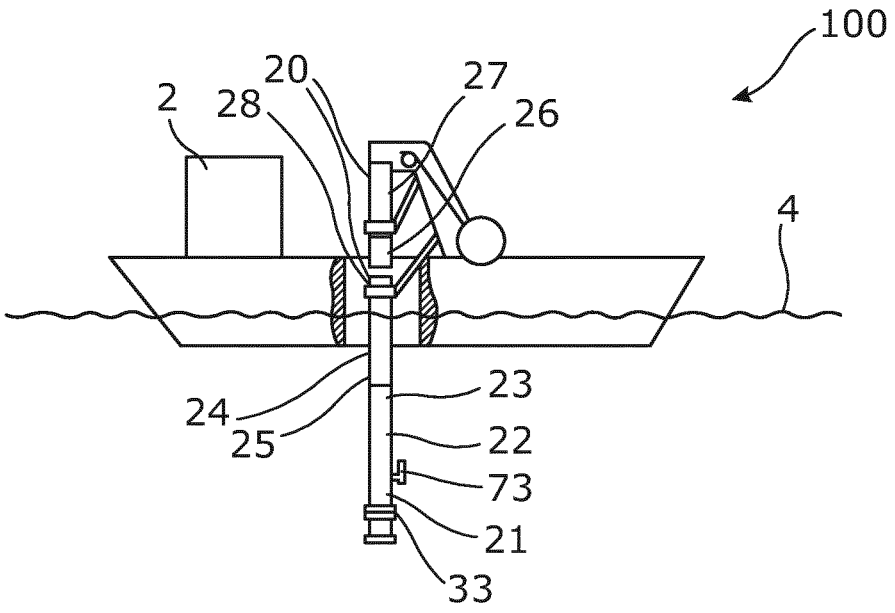
FIG. 5 shows a partially cross-sectional view of a small vessel in the process of mounting a third lubricator part and a second lubricator part of a lubricator pipe.
Figure 5:
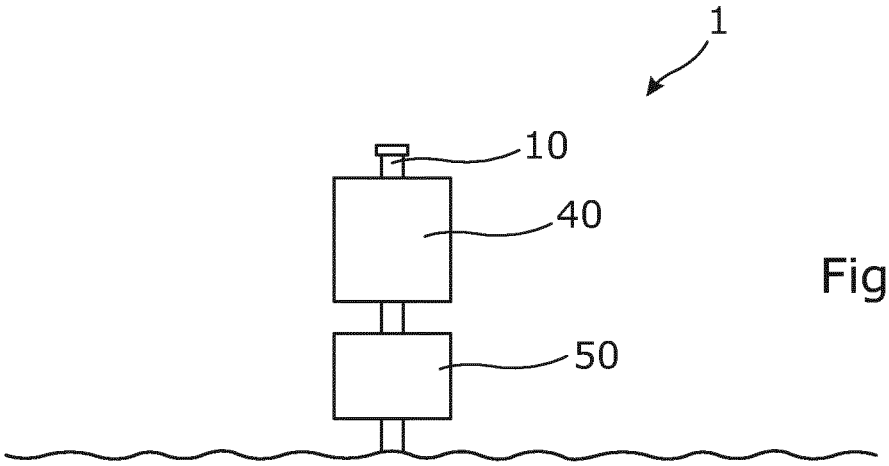
Figure 6:
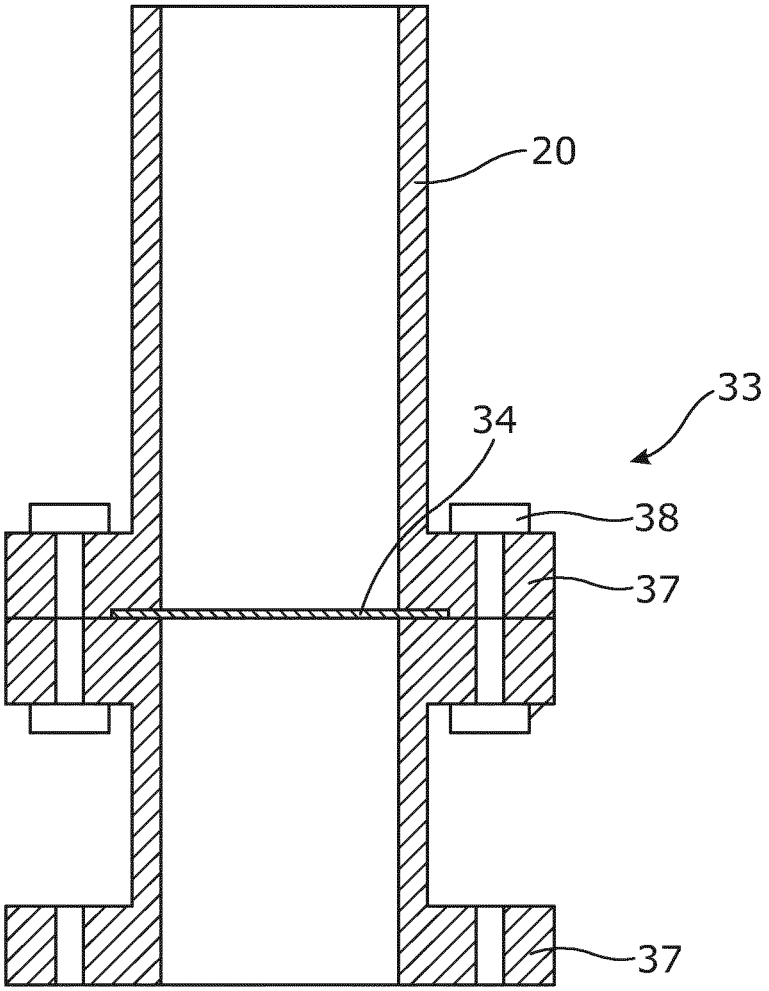
FIG. 6 shows a cross-sectional view of a closing unit arranged in a lubricator pipe.
Figure 7:
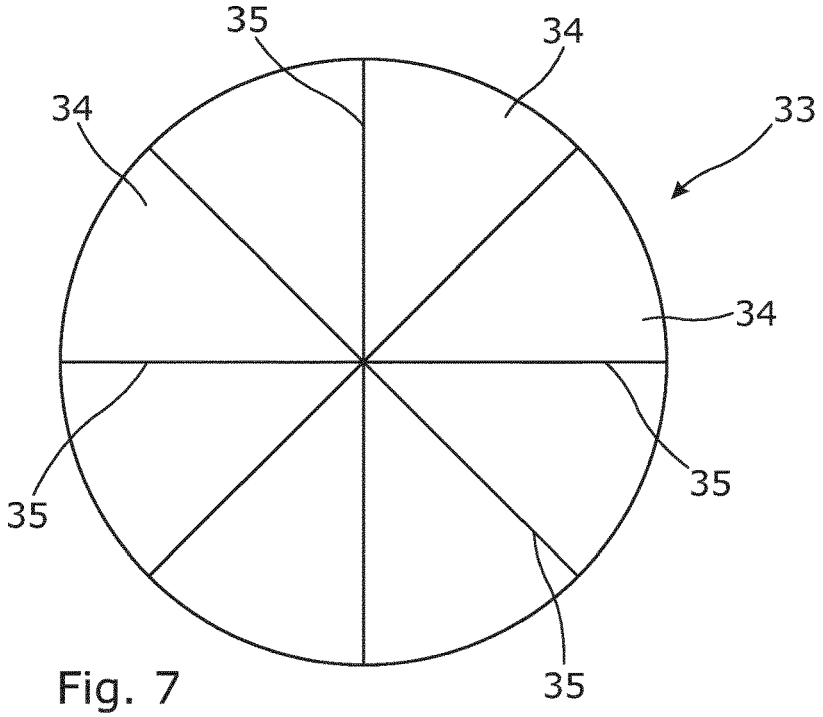
FIG. 7 shows the closing unit of FIG. 6 seen from above.

In FIG. 5, the second end 28 of the second lubricator part 24 is partly submerged into the water, and a first end 26 of a third lubricator part 27 of the lubricator pipe is mounted to a second end 28 of the second lubricator part 24. Subsequently, further lubricator parts can be mounted on top of the third lubricator part in the same manner by first partly submerging the previously mounted part below the waterline and then connecting the further part thereto until the entire lubricator pipe is assembled. The closing part 33 of the riserless intervention system 100 of FIG. 5 is a burst or rupture disc-shaped part arranged between two flanges as shown in FIG. 6. The two flanges are bolted together by means of bolts 38 and the closing part 33 is squeezed in between the flanges 37. The closing part has sections 34 as shown in FIG. 7, and when the tool string is to enter the well as shown in FIG. 4, the tool string presses itself past the closing part, breaking the sections 34 apart at the separation lines 35. The sections are thus somewhat flexible in order to allow the tool string to pass, but are also to close the second opening again when the tool string re-enters the lubricator pipe 20 and no longer forces the sections radially outwards. The pressure inside the lubricator pipe is substantially the same as the pressure in the sea before disconnecting the lubricator pipe. This equalisation is performed by a pressure equalising valve device 73 (shown in FIG. 5) for equalising the pressure inside the lubricator pipe with a liquid surrounding the lubricator pipe during descent and also ascent of the lubricator pipe. Thus, the closing part 33 needs only to separate the sea water and the liquid inside the lubricator pipe 20 and does not need to be able to carry the load of all the liquid inside the lubricator pipe 20.

Figure 8A:
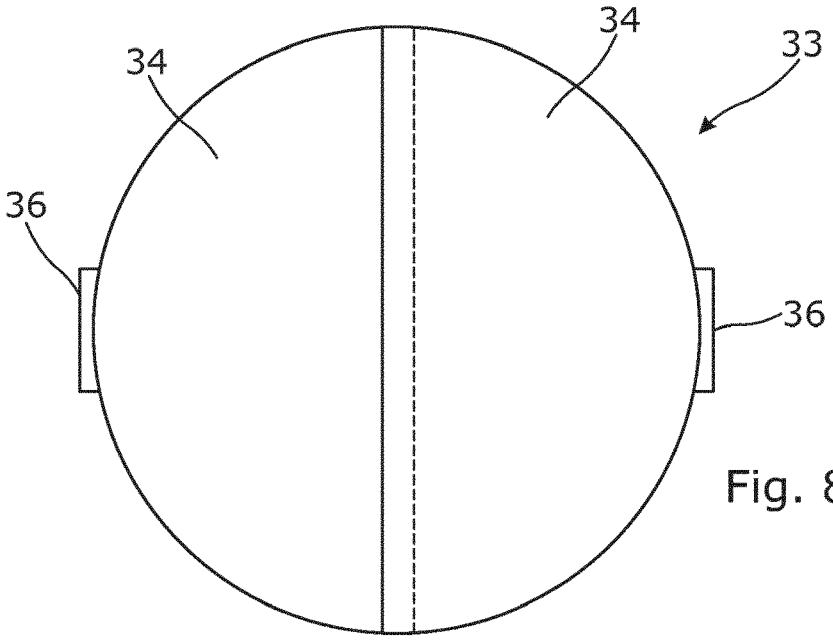
FIGS. 8*a* and 8*b* show another closing unit having two halves, the closing unit in FIG. 8*a* being seen from above, and in FIG. 8*b* from the side.
Figure 8B:
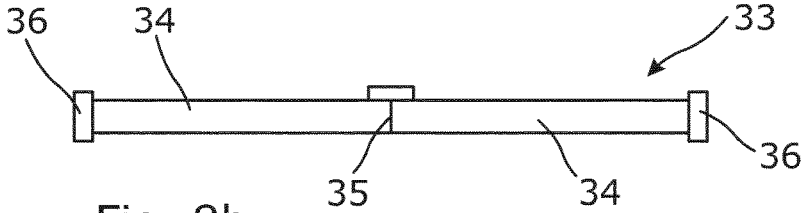
Figure 9:
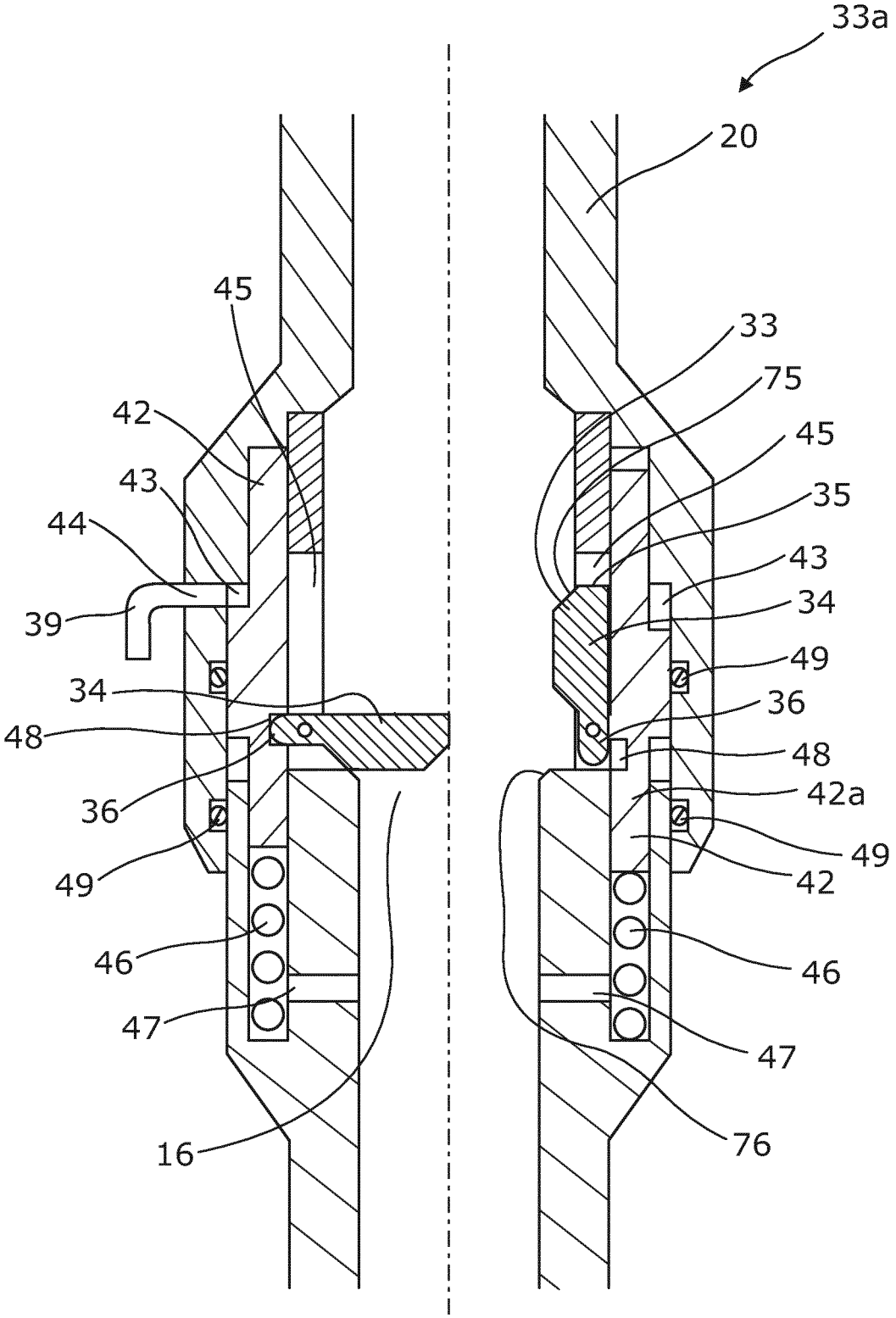
FIG. 9 shows a cross-sectional view of another embodiment of a closing unit.

In FIG. 4, the closing part 33 is comprised in a closing unit 33*a* as shown in FIG. 9 having an actuator 42 configured to bring the closing part from at least a closed position to an open position. In the left side of FIG. 9, the closing part is shown in its closed position closing the second opening 16, and in the right side of FIG. 9 the closing part is shown in its open position. The closing part 33 has two sections 34 as shown in FIGS. 8*a* and 8*b*, and the sections 34 are pivotably mounted by a hinge 36 in a groove 45. As shown in FIG. 9, the sections may have an inclined face 75 corresponding to a seat 76 in the closing unit 33*a*. The hinge 36 is hingedly connected to the body of the closing unit and moved by a piston sleeve 42*a* of the actuator 42. The piston sleeve 42*a* moves in an annular space 43 which is pressurised through the connection pipe 39. As the piston sleeve 42*a* is moved downwards to bring the closing part to its open position, a spring 46 is compressed as shown in the right side of FIG. 9. The fluid below the piston sleeve 42*a* is then forced out of the openings 47. Sealing means are arranged to seal the inside from the surrounding sea water. The hinge engages, in the left side of FIG. 9, an annular groove of the piston sleeve 42*a* to bring the closing part to the closed position.

Figure 10:
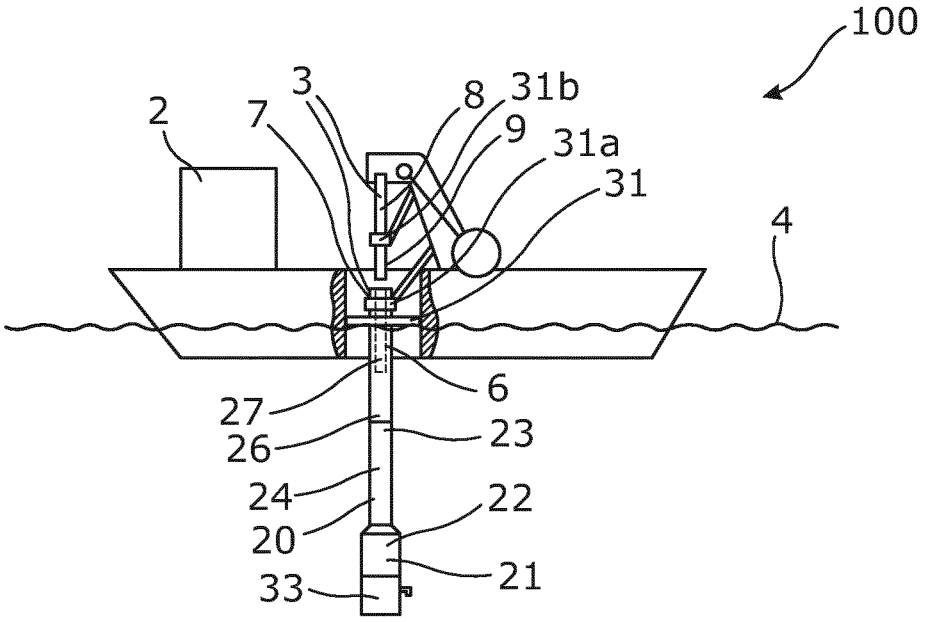
FIG. 10 shows another riserless intervention system having different inner diameters of the lubricator parts.
Figure 10:
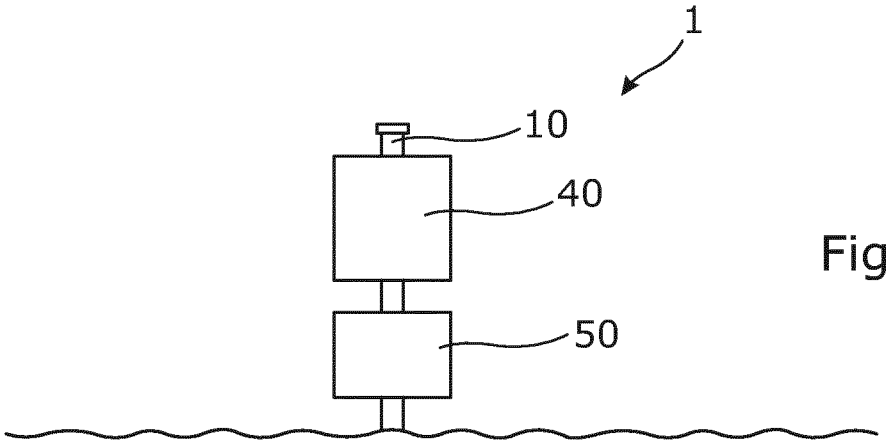
Figure 11:
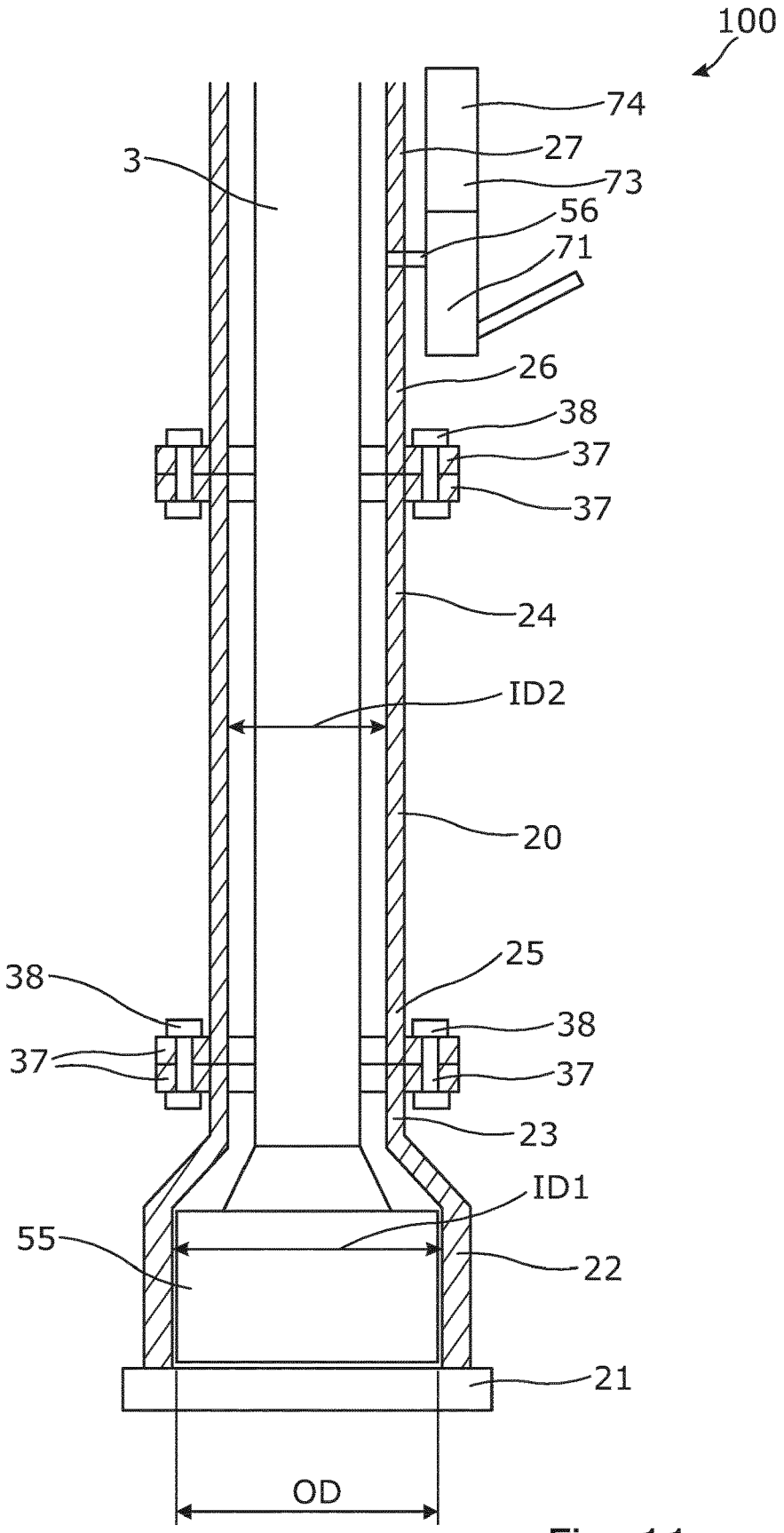
FIG. 11 shows a cross-sectional view of another lubricator pipe having different inner diameters of the lubricator parts.

As shown in FIG. 10, the first lubricator part 22 has an inner diameter ID1, shown in FIG. 11, which is larger than an inner diameter ID2 of the second lubricator part 24. The inner diameter ID1 of the first lubricator part is larger than an outer diameter OD of a crown plug 55. In this way, the internal volume of the lubricator pipe 20 is substantially reduced, which results in the amount of glycol used for such plug retrieval intervention being substantially reduced. Normally, the inner diameter of the lubricator pipe would correspond to the outer diameter of the crown plug and be the same along the whole lubricator pipe. Normally, a well has two crown plugs which are to be removed before an intervention by means of a tool string can be performed, and thus the lubricator pipe needs to be filled twice. The lubricator pipe 20 has a connection pipe 56 for letting liquid in and out during descent and ascent. The lubricator pipe 20 comprises a pressure equalising valve device 73 for equalising the pressure inside the lubricator pipe with a liquid surrounding the lubricator pipe during descent of the lubricator pipe below the waterline. The pressure equalising valve device 73 may comprise a relief valve for performing a simple equalisation of the pressure during ascent and descent. The valve is closed during pressurisation of the lubricator pipe before the tool string is to enter the well. The pressurisation may be performed by a remotely operated vehicle (ROV) 57 (shown in FIG. 1) operating a manual pump 71 fluidly connected to the lubrication pipe. The lubricator may further comprise a de-icing system 74.

As can be seen in FIG. 1, the ROV comprises a pump 58, a motor 59 for driving the pump and a pressure intensifier 60. The ROV may further comprise a coupling 61 configured to fluidly connect the pump to connection pipe 56 (shown in FIG. 11) of the lubricator pipe to pressurise the lubricator pipe. Thus, the lubricator pipe does not need to have any pressure means as a conventional ROV is just used. The ROV may further comprise a glycol reservoir (not shown).

After performing an intervention operation by means of the tool string, e.g. pulling a crown plug or milling out a safety valve, the tool string 3 re-enters the lubricator pipe and is fastened in a tool catcher 32 as shown in FIG. 4. Then, the valves in the top 10 of the well 1, e.g. in the blowout preventer 40, are closed, and the lubricator pipe is disconnected from the top 10 of the well 1. Before the lubricator pipe is disconnected, a closing part 33 is closed, thereby closing the second opening 16 (shown in FIG. 3) in the first end of the first lubricator part arranged closest to the top 10 of the well 1, so that the fluid inside the lubricator pipe remains therein while the pipe is brought to surface. The grease head 30 (shown in FIG. 4) is then disconnected and the tool string is dismounted part by part by pulling the lubricator pipe partly above the waterline 4 while it is still suspended from the vessel 2. Thus, the dirty fluid is kept in the lubricator pipe when the tool string is reconstructed or re-rigged, and the grease head 30 is subsequently re-mounted and the lubricator pipe with the tool string is mounted for another operation while the second end 19 of the lubricator pipe remains in the water and the closing part 33 keeps the seawater and the fluid inside the lubricator pipe from mixing.

When all the intervention operations have been performed, the tool string is disconnected part by part, and subsequently the lubricator pipe is disconnected part by part until all the lubricator parts are above the waterline.

When performing several intervention operations, such as retrieving two crown plugs before performing e.g. a cleaning operation, the riserless intervention system may comprise a plurality of lubricator pipes, so that when one tool string is performing an operation, the next lubricator pipe and another tool string are mounted to be ready. Thus, the riserless intervention system may also have a plurality of tool strings. The vessel may comprise a dynamic positioning system. The tool string or the lubricator pipe is arranged in a suspension unit 31 which may be a gyroscopic suspension unit, causing movements of the vessel 2 to be absorbed by the suspension unit. The vessel may also comprise a supply of anti-freeze liquid such as glycol.

Figure 12:
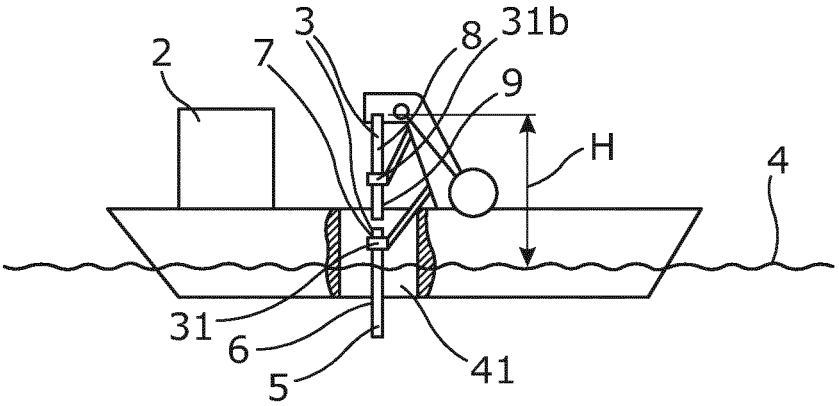
FIG. 12 shows a partially cross-sectional view of a small vessel in the process of mounting a first part and a second part of a tool string.
Figure 12:
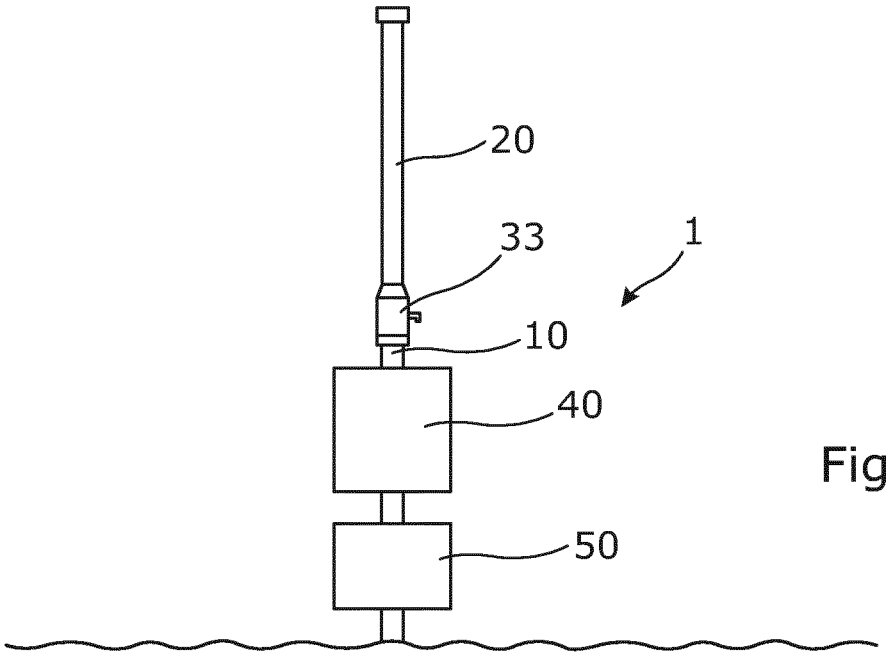

FIG. 12 shows a well 1 about to be intervened from a vessel 2 by an intervention tool 3 in the form of a tool string 3 comprising at least a first part 6 and a second part 8. When assembled, the tool string 3 is lowered into a lubricator pipe 20 mounted on e.g. a blowout preventer 40 or directly on a Christmas tree 50 forming a top 10 of the well 1.

The tool string 3 is mounted from the vessel 2 which is a small vessel having a mounting height smaller than a length of the lubricator pipe 20 and/or the tool string. The tool string 3 is mounted by submerging a first end 5 of the first part 6 of the tool string 3 below the waterline 4 of the vessel 2 so that a second end 7 of the first part extends above the waterline and is suspended in a suspension unit 31. The vessel 2 may have a moon pool 41 into which the tool part is lowered, or the tool string may be lowered over the side of the vessel (not shown). Then, the second part 8 of the tool string 3 is arranged on top of the first part 6 of the tool string by a second suspension unit 31*b*, and a first end 9 of the second part 8 of the tool string is connected with the second end 7 of the first part of the tool string above the waterline 4 while the remaining part of the first part is below the waterline. In this way, the mounting height of the vessel 2 can be substantially reduced, which eliminates the a need for a large vessel, which in turn substantially reduces costs related to renting a vessel and further reduces the time needed for planning and performing the operation. Furthermore, the length of the tool string 3 is no longer restricted by the mounting height available on the vessel 2, and the tool string can now in theory be mounted with an endless length.

Figure 17:
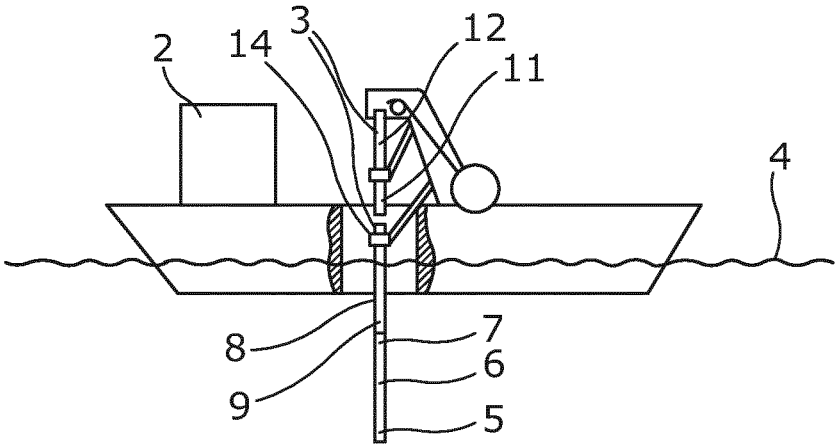
FIG. 17 shows a partially cross-sectional view of a small vessel in the process of mounting a third part and a second part of a tool string.
Figure 17:
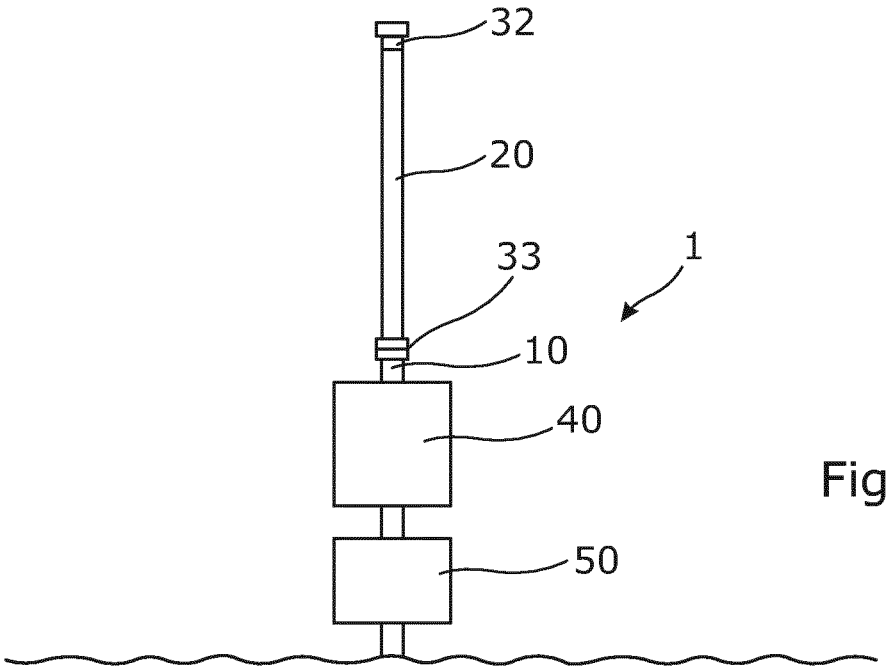

As shown in FIG. 17, the second part 8 of the tool string 3 is partly submerged into the water and a first end 11 of a third part 12 of the tool string is mounted to a second end 14 of the second part 8 of the tool string. Subsequently, further parts can be mounted on top of the third part 12 in the same manner by first partly submerging the previously mounted part below the waterline and then connecting the further part thereto until the entire tool string is assembled. Then, the tool string 3 can be introduced into a lubricator pipe 20.

Figure 13:
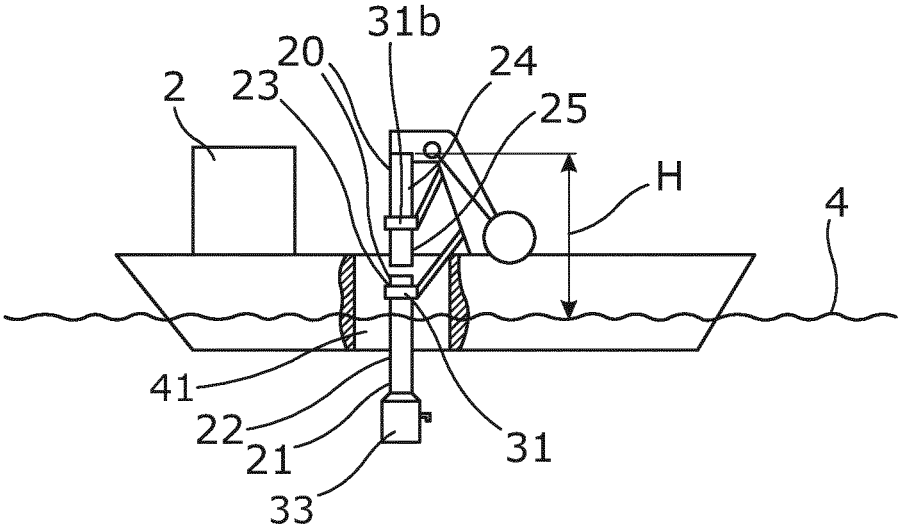
FIG. 13 shows a partially cross-sectional view of a small vessel in the process of mounting a first lubricator part and a second lubricator part of a lubricator pipe.
Figure 13:
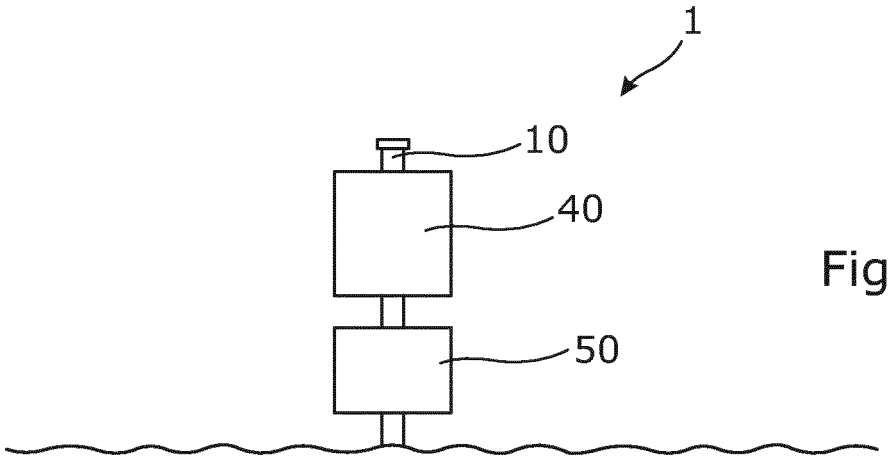

In FIG. 13, a lubricator pipe 20 is mounted from the vessel 2 having a mounting height H smaller than a length of the lubricator pipe 20. The mounting height extends from the deck of the waterline 4 of the vessel 2 to the summit of the highest possible reach of the lubricator pipe or tool string in the upward direction. The lubricator pipe 20 is mounted by submerging a first end 21 of a first lubricator part 22 of the lubricator pipe 20 below the waterline 4 so that a second end 23 of the first lubricator part is above the waterline. Then, a second lubricator part 24 is arranged on top of the first lubricator part 22 and a first end 25 of the second lubricator part is connected to the second end 23 of the first lubricator part. Finally, the lubricator pipe 20 is submerged into the sea and is connected to the top 10 of the well 1.

Figure 14:
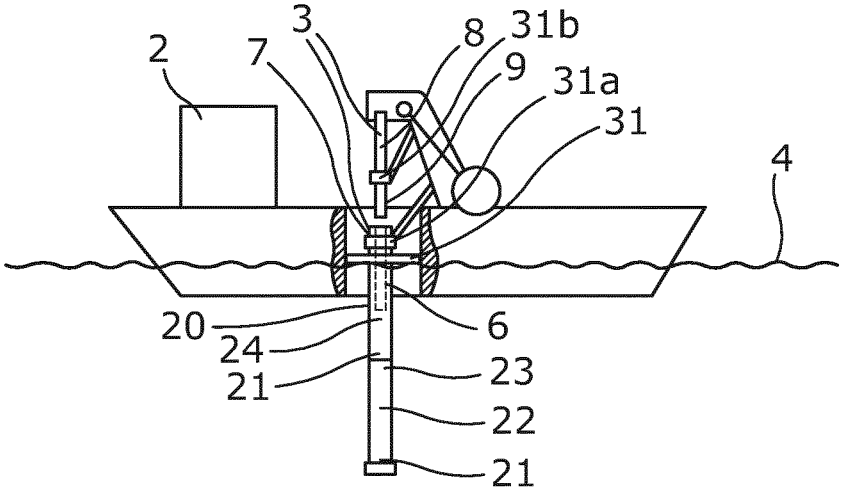
FIG. 14 shows a partially cross-sectional view of a small vessel in the process of mounting a first part and a second part of a tool string where the first part is partly within the lubricator pipe.
Figure 14:
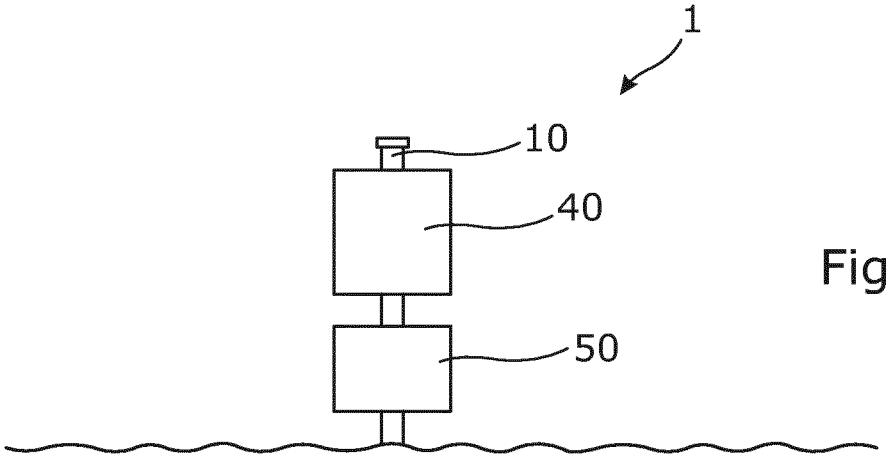
Figure 15:
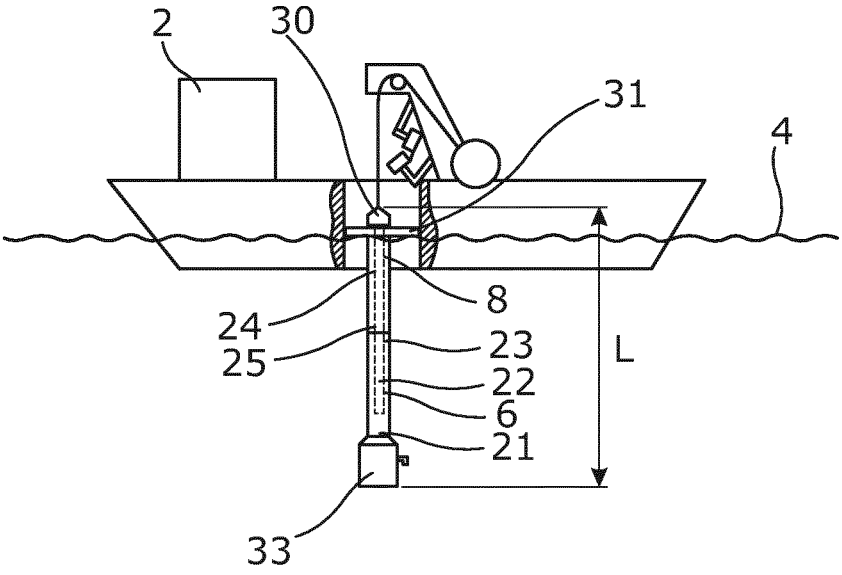
FIG. 15 shows a partially cross-sectional view of a small vessel in the process of lowering a lubricator pipe having a tool string therein into the sea.
Figure 15:
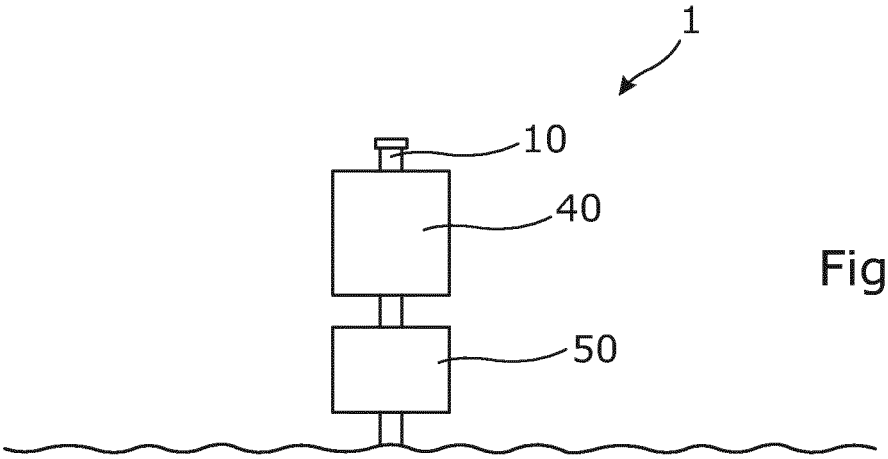
Figure 16:
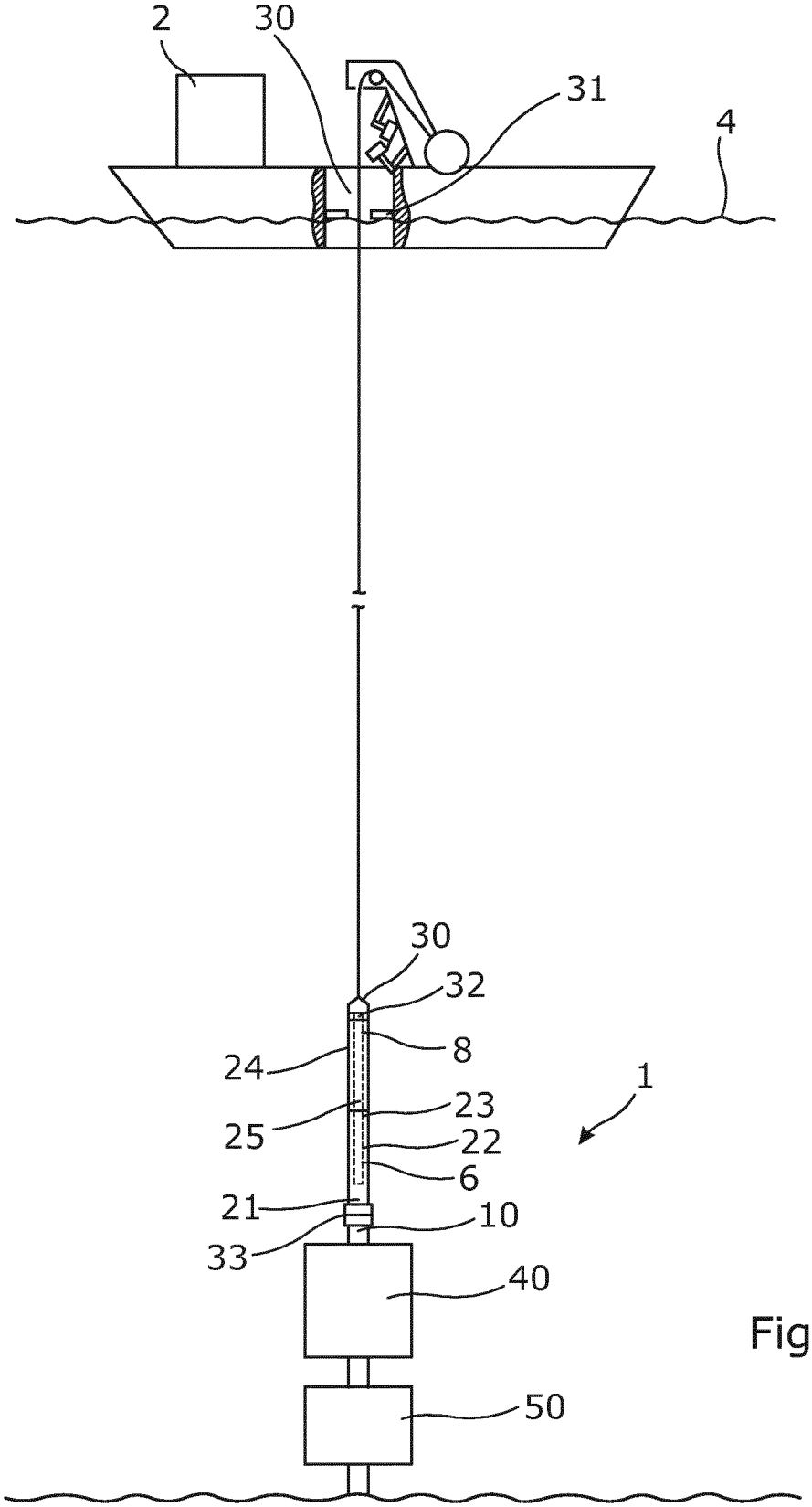
FIG. 16 shows the lubricator pipe of FIG. 15 being mounted on a top of a well.

Alternatively, the lubricator pipe may be maintained while being suspended in the suspension unit 31 of the vessel 2 while the tool string 3 is mounted, as shown in FIG. 14 where the first end of the first part 6 of the tool string 3 is submerged below the waterline 4 of the vessel into the lubricator pipe so that the second end 7 of the first part 6 extends above the waterline 4 and is suspended in a third suspension unit 31*a* while the second part 8 of the tool string is suspended in the second suspension unit 31*b*. When the tool string is fully mounted and arranged in the lubricator pipe, a grease head 30 is connected to the lubricator pipe above the waterline 4, as shown in FIG. 15, and the lubricator pipe is connected with the top 10 of the well 1, as shown in FIG. 16. Thus, the lubricator pipe is connected with the top 10 of the well 1 while the tool string is arranged within the lubricator pipe.

The tool string or the lubricator pipe is arranged in a suspension unit 31 which may be a gyroscopic suspension unit causing movements of the vessel 2 to be absorbed by the suspension unit.

After performing an intervention operation by means of the tool string, e.g. pulling a crown plug or milling out a safety valve, the tool string 3 re-enters the lubricator pipe and is fastened in a tool catcher 32 (shown in FIG. 16). Then, the valves in top 10 of the well 1, e.g. in the blowout preventer, are closed and the lubricator pipe is disconnected from the top 10 of the well 1. Before the lubricator pipe is disconnected, a closing unit 33*a* may be closed, thereby closing an opening (not shown) in the first end of the first lubricator part arranged closest to the top 10 of the well 1 so that the fluid inside the lubricator pipe remains therein while the pipe is brought to surface. The grease head 30 (shown in FIG. 16) is then disconnected and the tool string is dismounted part by part by pulling the lubricator pipe partly above the waterline 4 while it is still suspended from the vessel 2. Thus, the dirty fluid is kept in the lubricator pipe when the tool string is reconstructed or re-rigged, and the grease head 30 is subsequently re-mounted and the lubricator pipe with the tool string is mounted for another operation.

When all the intervention operations have been performed, the tool string is disconnected part by part, and subsequently, the lubricator pipe is disconnected part by part until all the lubricator parts are above the waterline.

Before submerging the lubricator pipe 20, the end of the lubricator pipe closest to the top 10 of the well 1 is closed by closing the closing unit 33 (shown in FIG. 17) and the lubricator pipe is filled with glycol or ethylene glycol so that the fluid inside the lubricator pipe does not freeze if the temperature is sufficiently low when the intervention is performed.

Figure 18:
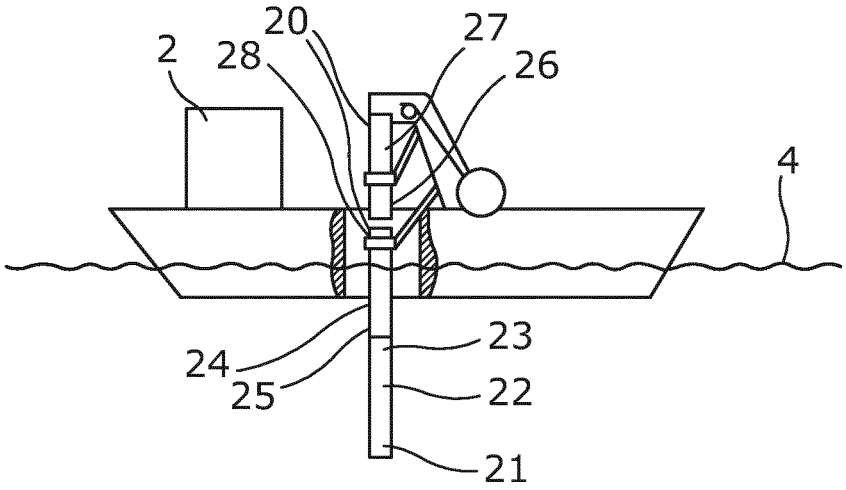
FIG. 18 shows a partially cross-sectional view of a small vessel in the process of mounting a third lubricator part and a second lubricator part of a lubricator pipe.
Figure 18:
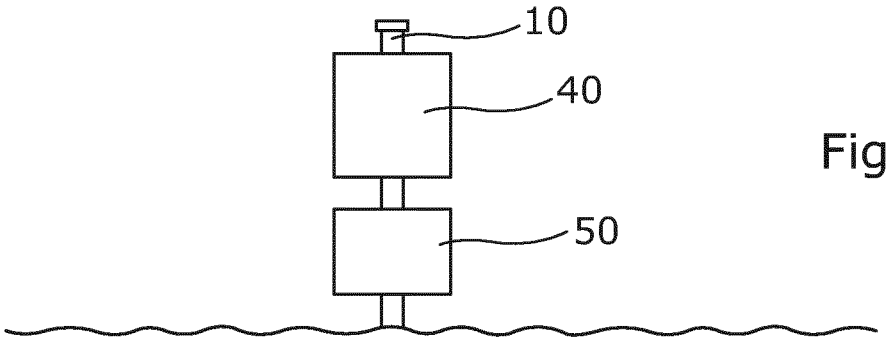

As shown in FIG. 18, the second end 28 of the second lubricator part 24 is partly submerged into the water and a first end 26 of a third lubricator part 27 of the lubricator pipe is mounted to a second end 28 of the second lubricator part 24. Subsequently, further lubricator parts can be mounted on top of the third lubricator part in the same manner by first partly submerging the previously mounted part below the waterline and then connecting the further part thereto until the entire lubricator pipe has been assembled.

The tool string may comprise several parts and operational tools arranged in the end facing the well. The parts of the tool string may be a stroker tool for pulling a crown plug, a key tool for moving a sliding sleeve, a milling tool for milling out a safety valve etc.

A stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A riserless intervention system for offshore intervention of a well from a vessel by means of a tool string, the vessel having a waterline and the well having a top, the riserless intervention system comprising:

a lubricator pipe comprising a first end and a second end, the second end being configured to connect with the top of the well, the first end having a first opening and the second end having a second opening, and the tool string configured to be arranged in and mounted to the lubricator pipe and subsequently the combined tool string and lubricator pipe are lowered and connected to the top of the well, wherein a single-use closing part is arranged at the second end and configured to close a fluid communication through the second opening of the second end of the lubricator pipe in order to allow the lubricator pipe to be filled with fluid before being lowered with the tool string and connected to the top of the well.

2. The riserless intervention system according to claim 1, wherein the single-use closing part is a burst or rupture disc-shaped part.

3. The riserless intervention system according to claim 1, wherein the closing part is comprised in a closing unit having an actuator configured to bring the closing part from at least a closed position to an open position.

4. The riserless intervention system according to claim 3, wherein the closing part has at least two sections.

5. The riserless intervention system according to claim 1, further comprising a grease head configured to be connected with the first end of the lubricator pipe, the grease head being arranged for closing fluid communication through the first opening of the first end of the lubricator pipe.

6. The riserless intervention system according to claim 5, wherein the lubricator pipe comprises a pressure equalising valve device for equalising the pressure inside the lubricator pipe with a liquid surrounding the lubricator pipe during descent of the lubricator pipe below the waterline.

7. The riserless intervention system according to claim 6, wherein the pressure equalising valve device is configured to allow liquid to enter the lubricator pipe during descent and to allow liquid inside the lubricator pipe to leave the lubricator pipe during ascent.

8. The riserless intervention system according to claim 1, wherein the lubricator pipe comprises at least a first lubricator part and a second lubricator part.

9. The riserless intervention system according to claim 8, wherein the pipe sections are connected by means of unions or flanges bolted together by bolts.

10. The riserless intervention system according to claim 8, wherein the second lubricator part is arranged closest to the grease head, the first lubricator part having an inner diameter which is larger than an inner diameter of the second lubricator part.

11. The riserless intervention system according to claim 10, wherein the inner diameter of the first lubricator part is larger than an outer diameter of a crown plug.

12. The riserless intervention system according to claim 1, further comprising a vessel, the vessel having a vessel height above the waterline which is smaller than a length of the tool string.

13. The riserless intervention system according to claim 1, wherein the lubricator pipe further comprises a tool catcher configured to maintain the tool string at a predetermined position in the lubricator pipe.

14. The riserless intervention system according to claim 1, wherein a manual pump is fluidly connected to the lubricator pipe.

15. The riserless intervention system according to claim 1, wherein the single-use closure part is configured to permanently open after the lubricator pipe has been connected to the top of the well.

16. A riserless intervention method for offshore intervention of a well from a vessel by means of a riserless intervention system comprising:

a lubricator pipe comprising a first end and a second end, the second end being configured to connect with the top of the well, the first end having a first opening and the second end having a second opening, and a tool string configured to be arranged in the lubricator pipe, wherein a closing part is arranged at the second end and configured to close a fluid communication through the second opening of the second end of the lubricator pipe in order to allow the lubricator pipe to be filled with fluid before being connected to the top of the well, the vessel having a waterline and the well having a top, the method comprising:

closing the second opening of the second end of the lubricator pipe using the closing part, submerging the second end of the lubricator pipe in the closed position of the second end below the waterline so that the first end of the lubricator pipe extends above the waterline, arranging the tool string in the lubricator pipe, and supplying the lubricator pipe with an anti-freeze liquid before the lubricator pipe is submerged below the waterline.

17. A riserless intervention method for offshore intervention of a well from a vessel by means of a tool string, the vessel having a waterline, the method comprising:

providing a lubricator pipe comprising a first end and a second end, the second end being configured to connect with the top of the well, the first end having a first opening and the second end having a second opening, closing the second opening of the second end of the lubricator pipe using a closing part, submerging the second end of the lubricator pipe in the closed position of the second end below the waterline so that the first end of the lubricator pipe extends above the waterline, submerging a first end of a first part of the tool string into the lubricator pipe below the waterline so that a second end of the first part extends above the waterline, arranging a second part of the tool string on top of the first part of the tool string, connecting a first end of the second part of the tool string with the second end of the first part of the tool string above the waterline, and submerging the second part of the tool string below the waterline, closing the first end of the lubricator pipe.

18. The riserless intervention method according to claim 17, further comprising introducing the tool string in a lubricator pipe.

19. The riserless intervention method according to claim 18, further comprising connecting a grease head to the lubricator pipe above the waterline.

20. The riserless intervention method according to claim 17, further comprising filling the pipe with a lubricator, prior to closing the first end of the lubricator pipe.

21. A riserless intervention method for offshore intervention of a well from a vessel by means of a tool string, the vessel having a waterline, the method comprising:

submerging a first end of a first part of the tool string below the waterline so that a second end of the first part extends above the waterline, arranging a second part of the tool string on top of the first part of the tool string, connecting a first end of the second part of the tool string with the second end of the first part of the tool string above the waterline, and submerging the second part of the tool string below the waterline, which before submerging the first end of the first part of the tool string below the waterline comprises:

submerging a first end of a first lubricator part of a lubricator pipe below the waterline so that a second end of the first lubricator part extends above the waterline, arranging a second lubricator part on top of the first lubricator part, and connecting a first end of the second lubricator part to the second end of the first lubricator part.

22. The riserless intervention method according to claim 21, wherein the tool string is submerged into the lubricator pipe.

* * * * *